US009759215B2

(12) United States Patent
Kawabata et al.

(10) Patent No.: US 9,759,215 B2
(45) Date of Patent: Sep. 12, 2017

(54) INTERNAL ROTOR-TYPE FLUID MACHINE

(71) Applicant: DENSO CORPORATION, Kariya-shi (JP)

(72) Inventors: Tomoaki Kawabata, Takahama (JP); Yuki Nakamura, Kariya (JP)

(73) Assignee: ADVICS CO., LTD., Kariya-Shi, Aichi-Ken (JP)

( * ) Notice: Subject to any disclaimer, the term of this patent is extended or adjusted under 35 U.S.C. 154(b) by 576 days.

(21) Appl. No.: 14/139,917

(22) Filed: Dec. 24, 2013

(65) Prior Publication Data

US 2014/0178234 A1 Jun. 26, 2014

(30) Foreign Application Priority Data

Dec. 24, 2012 (JP) ..... 2012-280403

(51) Int. Cl.
*F03C 4/00* (2006.01)
*F04C 18/00* (2006.01)
(Continued)

(52) U.S. Cl.
CPC ..... *F04C 15/0034* (2013.01); *F04C 2/10* (2013.01); *F04C 2/102* (2013.01); *F04C 15/0073* (2013.01)

(58) Field of Classification Search
CPC ... F04C 15/0073; F04C 15/0034; F04C 2/101
(Continued)

(56) References Cited

U.S. PATENT DOCUMENTS 7,669,577 B2 * 3/2010 Rosso ..... F04C 2/102 123/200
2007/0172371 A1 7/2007 Podmore
(Continued)

FOREIGN PATENT DOCUMENTS

CN 201090367 Y 7/2008
CN 101375019 A 2/2009
CN 101446286 A 6/2009
JP 59-091405 U 6/1984
(Continued)

OTHER PUBLICATIONS

Office Action (Notification of Reasons for Refusal) issued on Mar. 24, 2015, by the Japanese Patent Office in corresponding Japanese Patent Application No. 2012-280403 and an English translation of the Office Action. (12 page).
U.S. Appl. No. 13/950,031, filed Jul. 24, 2013, Naganuma et al.
Chinese Official Action issued on Jun. 27, 2016 by the Chinese Patent Office in corresponding Chinese Patent Application No. 201310721963.6 with English-language translation (14 pages).

*Primary Examiner* — Mark Laurenzi
*Assistant Examiner* — Anthony Ayala Delgado
(74) *Attorney, Agent, or Firm* — Buchanan Ingersoll & Rooney PC

(57) ABSTRACT

An internal rotor-type fluid machine includes a rotary shaft, a rotor which rotates together with the rotary shaft, a support portion which is provided on the rotary shaft or the rotor, and which supports the rotary shaft to be tiltable with respect to the rotor, and a pressure chamber inner wall surface which configures a pressure chamber by contacting an end surface of the rotor in an axial direction. The rotor is pressed toward the rotary shaft by a high fluid pressure, based on a pressure difference in the pressure chamber between a high pressure side and a low pressure side having a lower pressure than the high pressure side. The support portion is deviated in a direction away from the pressure chamber inner wall surface further than a center position of the rotor in the axial direction.

9 Claims, 8 Drawing Sheets

(51) Int. Cl.
*F04C 2/00* (2006.01)
*F04C 15/00* (2006.01)
*F04C 2/10* (2006.01)

(58) Field of Classification Search
USPC ..... 418/104, 171, 166
See application file for complete search history.

(56) References Cited

U.S. PATENT DOCUMENTS

| | | | | |
|---|---|---|---|---|
| 2012/0051959 | A1* | 3/2012 | Nakamura ..... | F16J 15/061 418/104 |
| 2012/0051960 | A1 | 3/2012 | Nakamura et al. | |
| 2013/0101448 | A1 | 4/2013 | Ando et al. | |

FOREIGN PATENT DOCUMENTS

| | | | |
|---|---|---|---|
| JP | 62-102886 | U | 6/1987 |
| JP | 11-132160 | A | 5/1999 |
| JP | 2012-052455 | A | 3/2012 |

* cited by examiner

INTERNAL ROTOR-TYPE FLUID MACHINE

CROSS REFERENCE TO RELATED APPLICATIONS

This application is based on and claims priority under 35 U.S.C.§119 to Japanese Patent Application 2012-280403, filed on Dec. 24, 2012, the entire content of which is incorporated herein by reference.

BACKGROUND

Field of the Invention

The present invention relates to an internal rotor-type fluid machine which includes a rotor configured to be rotated while being supported by a rotary shaft, and which may be preferably applied, for example, to a gear pump device such as a trochoid pump for pumping a liquid by gear engagement between an inner rotor and an outer rotor.

Description of Related Art

For example, JP-A-H11-132160 discloses an internal rotor-type fluid machine. The internal rotor-type fluid machine has a structure in which a rotary shaft is fitted into a center hole of a rotor, and a support portion is provided at a center position of the rotor in an axial direction on an entire inner peripheral surface, which configures the center hole of the rotor, to protrude therefrom. In a case where the center hole of the rotor has a simple cylindrical shape without providing the support portion, when a force is applied to the rotor inwardly in a radial direction, the inner peripheral surface of the rotor comes into line contact with the rotary shaft. Accordingly, if the rotary shaft is tilted, the rotor is also tilted. In view of this problem, the support portion is provided on the inner peripheral surface of the rotor to protrude therefrom at the center position in the axial direction, so that the support portion is brought into point contact with the rotary shaft. According to this configuration, even when the rotary shaft is tilted, the rotor is not tilted. Since the rotor is configured to be not tilted as described above, gap generation between the rotor and an end surface of a case can be suppressed, thereby ensuring sealing performance between the rotor and the end surface of the case.

SUMMARY

However, even when the support portion is provided on the inner peripheral surface of the rotor to be brought into point contact with the rotary shaft, it is confirmed that if a high fluid pressure is applied to the outer periphery of the rotor, a rotational moment is generated in a direction in which the rotor is separated from the end surface of the case. This phenomenon will be explained with reference to FIGS. 8A and 8B.

FIGS. 8A and 8B are schematic views illustrating a rotational moment applied to a structure having a support portion J4 on an inner peripheral surface of a rotor J1 at a center position in an axial direction, in an internal rotor-type fluid machine having a structure where a rotary shaft J3 is fitted into a center hole J2 of the rotor J1.

In the internal rotor-type fluid machine illustrated in FIGS. 8A and 8B, when not in use, one end surface of the rotor J1 in the axial direction is in contact with a sealing surface J6 defined on one surface of a case J5, as illustrated by a broken line in FIGS. 8A and 8B, thereby ensuring sealing performance between the surfaces. When the internal rotor-type fluid machine is operated, for example, a high pressure inside a pressure chamber is applied from the upper side in FIGS. 8A and 8B on the outer peripheral surface of the rotor J1, and a gap between the inner peripheral surface of the rotor J1 and the rotary shaft J3 at the lower side of FIGS. 8A and 8B of the rotor J1 is caused to have a low pressure.

In this case, as illustrated in FIG. 8A, if the support portion J4 has a rectangular shape in cross section, when the rotary shaft J3 is tilted, a corner portion J7 of the support portion J4 at a side of the sealing surface J6 comes into contact with the rotary shaft J3. Thus, across a plane which passes through the corner portion J7 and is parallel to a radial direction of the rotary shaft J3, an area difference occurs in the outer peripheral surface of the rotor J1 between a side of the case J5 and a side away from the case J5 with respect to the corner portion J7. Therefore, the rotational moment due to the area difference is generated. Accordingly, the counterclockwise rotational moment is generated, and the rotor J1 is moved counterclockwise from the position illustrated by the broken line in FIG. 8A. Therefore, the end surface of the rotor J1 at the vicinity of a high pressure side pressure chamber is separated from the sealing surface J6.

As illustrated in FIG. 8B, if the support portion J4 has a semicircular shape in cross section, when the rotary shaft J3 is tilted, one point of the support portion at a side of the sealing surface J6 comes into contact with the rotary shaft J3. That is, the support portion J4 comes into contact with the rotary shaft J3 at a side of the sealing surface J6 with respect to the center position of the rotor J1 in the axial direction. Therefore, similar to the case where the support portion J4 has the rectangular shape, the rotational moment is generated in a direction in which the end surface of the rotor J1 at the vicinity of the high pressure side pressure chamber is separated from the sealing surface J6.

In this manner, the rotational moment is generated in the direction in which the end surface of the rotor J1 at the vicinity of the high pressure side pressure chamber is separated from the sealing surface J6. If the rotational moment is increased, the sealing performance between the rotor and the end surface of the case may not be ensured.

The present invention has been made in view of the above-described circumstances, and an object of the present invention is to provide an internal rotor-type fluid machine which can further ensure a sealing performance by suppressing generation of the rotational moment in the direction in which the end surface of the rotor at the vicinity of the high pressure side pressure chamber is separated from a pressure chamber inner wall surface which serves as the sealing surface of the case.

According to an aspect of the present invention, there is provided an internal rotor-type fluid machine comprising: a rotary shaft (54); a rotor (19*b*, 39*b*) which rotates together with the rotary shaft (54); a support portion (19*bb*, 39*bb*) which is provided on the rotary shaft (54) or the rotor (19*b*, 39*b*), and which supports the rotary shaft (54) to be tiltable with respect to the rotor (19*h*, 39*b*); and a pressure chamber inner wall surface (71*b*, 71*c*) which configures a pressure chamber (19*c*, 39*c*) by contacting an end surface of the rotor (19*b*, 39*b*) in an axial direction. The rotor (19*b*, 39*b*) is pressed toward the rotary shaft (54) by a high fluid pressure, based on a pressure difference in the pressure chamber (19*c*, 39*c*) between a high pressure side and a low pressure side having a lower pressure than the high pressure side. The support portion (19*bb*, 39*bb*) is deviated in a direction away from the pressure chamber inner wall surface (71*b*, 71*c*) further than a center position of the rotor (19*b*, 39*b*) in the axial direction.

According to this configuration, the support portion (19*bb*, 39*bb*) is deviated in the direction away from the pressure chamber inner wall surface (71*b*, 71*c*) further than the center position of the rotor (19*b*, 39*b*) in the axial direction of the rotary shaft (54). Therefore, when the rotor (19*b*, 39*b*) is pressed toward the rotary shaft (54) by the high fluid pressure, it is possible to prevent generation of the rotational moment in the direction in which the end surface of the rotor (19*b*, 39*b*) at the vicinity of the high pressure side pressure chamber is separated from the pressure chamber inner wall surface (71*b*, 71*c*). Accordingly, it is possible to further ensure the sealing performance between the rotor (19*b*, 39*b*) and the pressure chamber inner wall surface (71*b*, 71*c*).

In the above internal rotor-type fluid machine, in a state where the rotor (19*b*, 39*b*) is pressed toward the rotary shaft (54), a rotational moment may be generated by the high fluid pressure in a direction in which the end surface of the rotor (19*b*, 39*b*) in the axial direction is pressed toward the pressure chamber inner wall surface (71*b*, 71*c*) with a portion where the support portion (19*bb*, 39*bb*) comes into contact with the rotary shaft (54) serving as a fulcrum.

According to this configuration, it is possible to further ensure the sealing performance by generating the rotational moment which presses the rotor (19*b*, 39*b*) toward the pressure chamber inner wall surface (71*b*, 71*e*).

Further, in the above internal rotor-type fluid machine, the fulcrum may be positioned away from the pressure chamber inner wall surface (71*b*, 71 *c*) in the axial direction further than the center position of the rotor (19*b*, 39*b*) in the axial direction.

According to this configuration, it is possible to generate the rotational moment which presses the rotor (19*b*, 39*b*) toward the pressure chamber inner wall surface (71*b*, 71*c*).

Further, in the above internal rotor-type fluid machine, one end surface of end surfaces of the rotor (19*b*, 39*b*) in the axial direction may be sealed by coming into contact with a sealing mechanism (111, 115) to be pressed toward the rotor (19*h*, 39*b*) by the high fluid pressure, and the other end surface of the rotor (19*b*, 39*h*) may be sealed by the rotor (19*b*, 39*b*) coming into contact with the pressure chamber inner wall surface (71*b*, 71*c*) by a force which presses the sealing mechanism (111, 115) to the rotor (19*b*, 39*b*).

In a case of a structure where the end surface of the rotor (19*b*, 39*b*) is pressed by the sealing mechanism (111, 115), if the rotational moment is increased in the direction in which the other end surface is separated from the pressure chamber inner wall surface (71*b*, 71*c*), it is not possible to ensure the sealing performance. Therefore, in this configuration, it is preferable to prevent generation of the rotational moment in the direction in which the end surface of the rotor (19*b*, 39*b*) at the vicinity of the high pressure side pressure chamber is separated from the pressure chamber inner wall surface (71*b*, 71*c*).

Further, in the internal rotor-type fluid machine, the support portion (19*bb*, 39*bb*) may be provided on the rotor (19*b*, 39*b*) and have a tip surface which is brought into surface contact with the rotary shaft (54), and if the rotary shaft (54) is tilted, the support portion (19*bb*, 39*bb*) may be brought into line contact with the rotary shaft (54).

According to this configuration, since the way of the contact between the tip of the support portion (19*bb*, 39*bb*) and the rotary shaft (54) is surface contact, as compared to a case of the line contact, a contacting area becomes wider. Therefore, it is possible to maintain high durability.

According to another aspect of the present invention, there is provided a gear pump device comprising: a rotary shaft (54); a inner rotor (19*b*, 39*b*) which is formed with a center hole (19*b*, 39*b*), to which the rotary shaft (54) is inserted, and rotates together with the rotary shaft (54); an outer rotor (19*c*, 39*c*) which is provided at an outer circumference of the inner rotor (19*b*, 39*b*); a support portion (19*bb*, 39*bb*) which is provided on an inner peripheral surface of the inner rotor (19*b*, 39*b*), and which supports the rotary shaft (54) to be tiltable with respect to the inner rotor (19*b*, 39*b*); and a pressure chamber inner wall surface (71*b*, 71*c*) which configures a pressure chamber (19*c*, 39*c*) which is a gap formed between the inner rotor (19*b*, 39*b*) and the outer rotor (19*c*, 39*c*), by contacting an end surface of the inner rotor (19*b*, 39*b*) in an axial direction of the inner rotor (19*b*, 39*b*). The inner rotor (19*b*, 39*b*) is pressed toward the rotary shaft (54) by a high fluid pressure, based on a pressure difference in the pressure chamber (19*c*, 39*c*) between a high pressure side and a low pressure side having a lower pressure than the high pressure side. The support portion (19*bb*, 39*bb*) is deviated in a direction away from the pressure chamber inner wall surface (71*b*, 71*c*) further than a center position of the rotary shaft (54) in the axial direction.

Reference numerals in parentheses of the above-described respective elements represent merely examples of correspondence relation with specific elements described in illustrative embodiments to be described later.

BRIEF DESCRIPTION OF THE DRAWINGS

The foregoing and additional features and characteristics of this disclosure will become more apparent from the following detailed description considered with the reference to the accompanying drawings, wherein.

DETAILED DESCRIPTION

Figure 1:
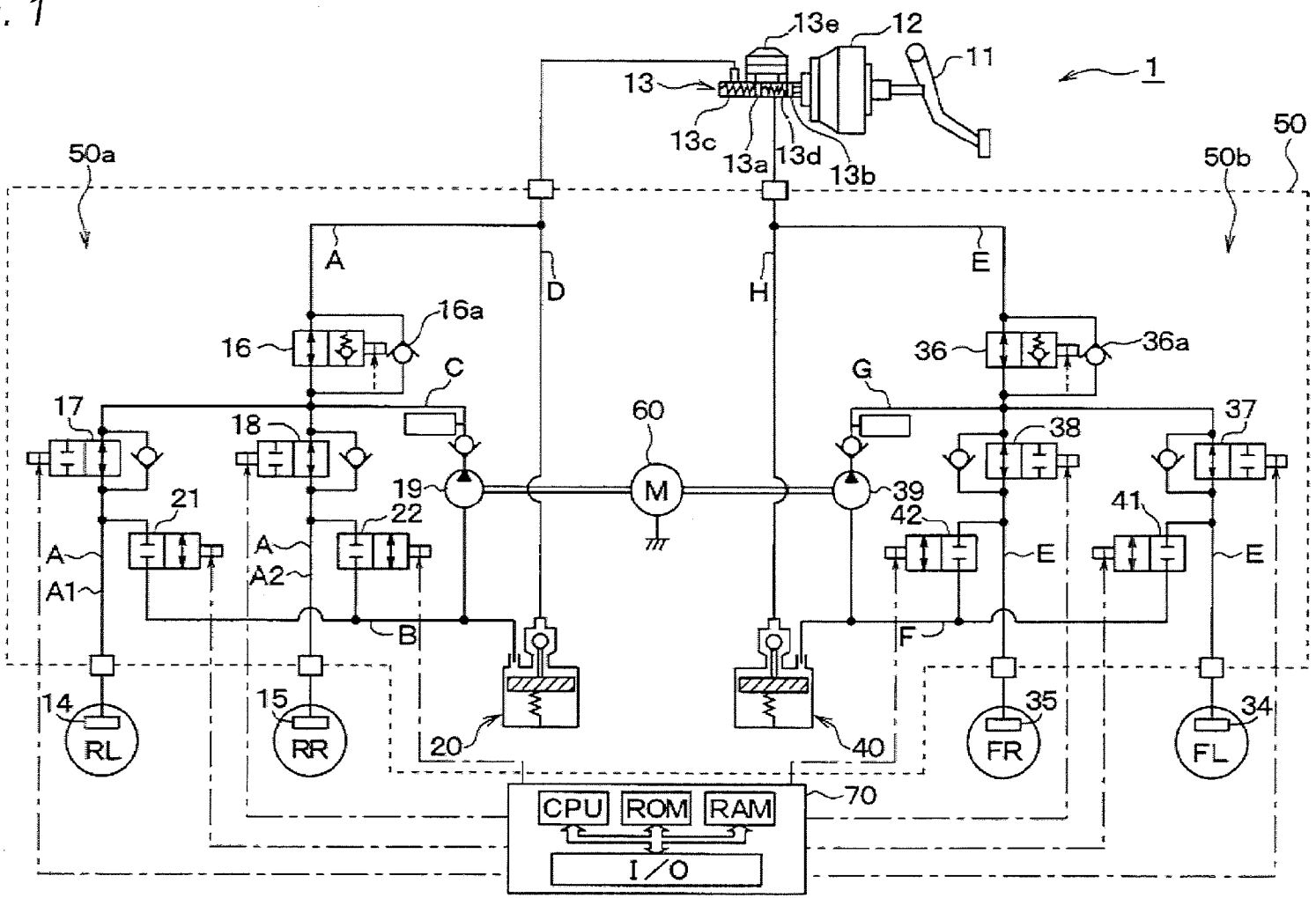
FIG. 1 illustrates a hydraulic circuit of a vehicle braking device 1 employing a gear pump device which is an internal rotor-type fluid machine according to a first illustrative embodiment.

Hereinafter, illustrative embodiments of the present invention will be described with reference to the drawings. In the following description of the respective illustrative embodiments, the same reference numerals are given to elements which are the same as or equivalent to each other.

First Illustrative Embodiment

FIG. 1 illustrates a hydraulic circuit of a vehicle braking device 1 employing a gear pump device which is an internal rotor-type fluid machine according to a first illustrative embodiment. With reference to FIG. 1, a basic configuration of the vehicle braking device 1 of the present illustrative embodiment will be described. Here, an example will be described in which the vehicle braking device 1 is applied to a vehicle having the hydraulic circuit of front and rear piping system. However, the vehicle braking device 1 can also be applied to an X-piping system having a first piping system for a right front wheel and a left rear wheel, and a second piping system for a left front wheel and a right rear wheel.

As illustrated in FIG. 1, the vehicle braking device 1 includes a brake pedal 11, booster 12, an M/C 13, W/Cs 14, 15, 34 and 35, and a brake fluid pressure controlling actuator 50. The brake fluid pressure controlling actuator 50 is assembled with a brake ECU 70, and the brake ECU 70 controls a braking force generated by the vehicle braking device 1.

The brake pedal 11 is connected to the booster 12 and the M/C 13, and when a driver steps on the brake pedal 11, stepping force is boosted by the booster 12, thereby pressing master pistons 13*a* and 13*b* which are provided in the M/C 13. This generates an equal M/C pressure in a primary chamber 13*c* and a secondary chamber 13*d* which are divided by the master pistons 13*a* and 13*b*. The M/C pressure generated in the M/C 13 is transferred to the respective W/Cs 14, 15, 34 and 35 through the brake fluid pressure controlling actuator 50 configuring a fluid pressure path.

The M/C 13 is connected with a master reservoir 13*e* having a path for communicating with the primary chamber 13*c* and the secondary chamber 13*d*. The master reservoir 13*e* supplies a brake fluid into the M/C 13 and stores the brake fluid which remains excessive in the M/C 13.

The brake fluid pressure controlling actuator 50 has a first piping system 50*a* and a second piping system 50*h*. The first piping system 50*a* serves as a rear system for controlling a brake fluid pressure applied to a right rear wheel RR and a left rear wheel RL, and the second piping system 50*b* serves as a front system for controlling a brake fluid pressure applied to a left front wheel FR and a right front wheel FR.

Hereinafter, the first and second piping systems 50*a* and 50*b* will be described. However, the first piping system 50*a* and the second piping system 50*b* have substantially the same configuration. Therefore, here, the first piping system 50*a* will be described, and reference is made to the first piping system 50*a* for the description of the second piping system 50*b*.

The first piping system 50*a* includes a pipeline A serving as a main pipeline which transfers the above-described M/C pressure to the W/C 14 provided to the left rear wheel RL and the W/C 15 provided to the right rear wheel RR so as to generate a W/C pressure. The W/C pressure is generated in the respective W/Cs 14 and 15 through the pipeline A, thereby generating the braking force.

The pipeline A is provided with a differential pressure control valve 16 which can control a communication state and a different pressure state. The differential pressure control valve 16 is configured such that a valve position is adjusted to the communication state during a normal braking time (when a motion control is not performed) for generating the braking force corresponding to a driver's operation of the brake pedal 11. Then, if a current flow in a solenoid coil provided to the differential control valve 16, the differential control valve 16 adjusts the valve position to become a larger different pressure state as a current value is larger. If the differential pressure control valve 16 is caused to be in the different pressure state, a flow of the brake fluid is restricted such that the W/C pressure becomes higher than the M/C pressure by a different pressure amount.

The pipeline A is divided into two pipelines A1 and A2 at a side of the W/Cs 14 and 15, which are downstream from the differential pressure control valve 16. The pipeline A1 includes a pressure boost control valve 17 which controls a pressure boost of the brake fluid supplied to the W/C 14. The pipeline A2 includes a pressure boost control valve 18 which controls a pressure boost of the brake fluid supplied to the W/C 15.

The pressure boost control valves 17 and 18 are configured by a two-position electromagnetic valve which can control a communication state and a blocked state. The pressure boost control valves 17 and 18 are configured as normally open type valves which can control the communication state during a non-energizing time when a control current does not flow in solenoid coils provided to the pressure boost control valves 17 and 18, and the blocked state during an energizing time when the control current flows in the solenoid coils.

A pressure reduction control valve 21 and a pressure reduction control valve 22 are respectively provided in the pipeline B as a pressure reduction pipeline which connects a pressure regulating reservoir 20 to a portion between the pressure boost control valves 17 and 18 in the pipeline A and to a portion between the respective W/Cs 14 and 15. The pressure reduction control valves 21 and 22 are configured by a two position electromagnetic value which can control a communication state and a blocked state, and is configured as normally closed type valves which become in the blocked state during the non-energizing time.

A pipeline C serving as a reflux pipeline is provided between the pressure regulating reservoir 20 and the pipeline A. The pipe line C is provided with a self-suction pump 19 which is driven by a motor 60 such that the brake fluid is suctioned from the pressure regulating reservoir 20 and is discharged toward the M/C 13 or the W/Cs 14 and 15.

A pipeline D serving as an auxiliary pipeline is provided between the pressure regulating reservoir 20 and the M/C 13. The brake fluid is suctioned by the gear pump 19 from the M/C 13 through the pipeline D and is discharged to the pipeline A. In this manner, the brake fluid is supplied toward the W/Cs 14 and 15, and the W/C pressure of a control object wheel is increased during the motion control such as an antiskid control or a traction control.

On the other hand, as described above, the second piping system 50*b* has substantially the same configuration as that of the first piping system 50*a*, Specifically, the differential pressure control valve 16 corresponds to a differential pressure control valve 36. The pressure boost control valves 17 and 18 respectively correspond to pressure boost control valves 37 and 38. The pressure reduction control valves 21 and 22 respectively correspond to pressure reduction control valves 41 and 42. The pressure regulating reservoir 20 corresponds to a pressure regulating reservoir 40. The gear pump 19 corresponds to a gear pump 39. In addition, the pipelines A, B, C and D respectively correspond to pipelines E, F, G and H. The hydraulic circuit of the vehicle braking device 1 is configured in the above-described manner, and the gear pump device has the gear pumps 19 and 39 integrated thereto. A detailed structure of the gear pump device will be described later.

The brake ECU 70 takes a role as a control system of the vehicle braking system 1, and is configured by a known microcomputer including a CPU, a ROM, a RAM, an I/O and the like. The brake ECU 70 performs a process such as various calculating operations according to a program stored in the ROM or the like, and performs a vehicle motion control such as the antiskid control. Specifically, the brake ECU 70 calculates various physical quantities based on detection of a sensor (not illustrated), and determines whether or not to perform the vehicle motion control based on the calculation result. Then, when performing the vehicle motion control, the brake ECU 70 obtains a control amount for the control object wheel, that is, the W/C pressure to be generated in the W/C of the control object wheel. Based on the result, the brake ECU 70 controls the motor 60 for driving the respective control valves 16, 17, 18, 21, 22, 36, 37, 38, 41 and 42 and the gear pumps 19 and 39, thereby controlling the W/C pressure of the control object wheel and performing the vehicle motion control.

For example, when the pressure is not generated in the M/C 13 as in the traction control or the antiskid control, the gear pumps 19 and 39 are driven and the differential control valves 16 and 36 are caused to be in the different pressure state. Accordingly, the brake fluid is supplied to a downstream side of the differential pressure control valves 16 and 36, that is, the W/Cs 14, 15, 34 and 35 sides through the pipelines D and H. Then, the pressure boost control valves 17, 18, 37 and 38, or the pressure reduction control valves 21, 22, 41 and 42 are appropriately controlled, thereby controlling the increase and decrease in the W/C pressure of the control object wheel and controlling the W/C pressure to have a desired control amount.

In addition, during the antiskid (ABS) control, the pressure boost control valves 17, 18, 37 and 38 or the pressure reduction control valves 21, 22, 41 and 42 are appropriately controlled, and the gear pumps 19 and 39 are driven, thereby controlling the increase and decrease in the W/C pressure and controlling the W/C pressure to have the desired control amount.

Figure 2:
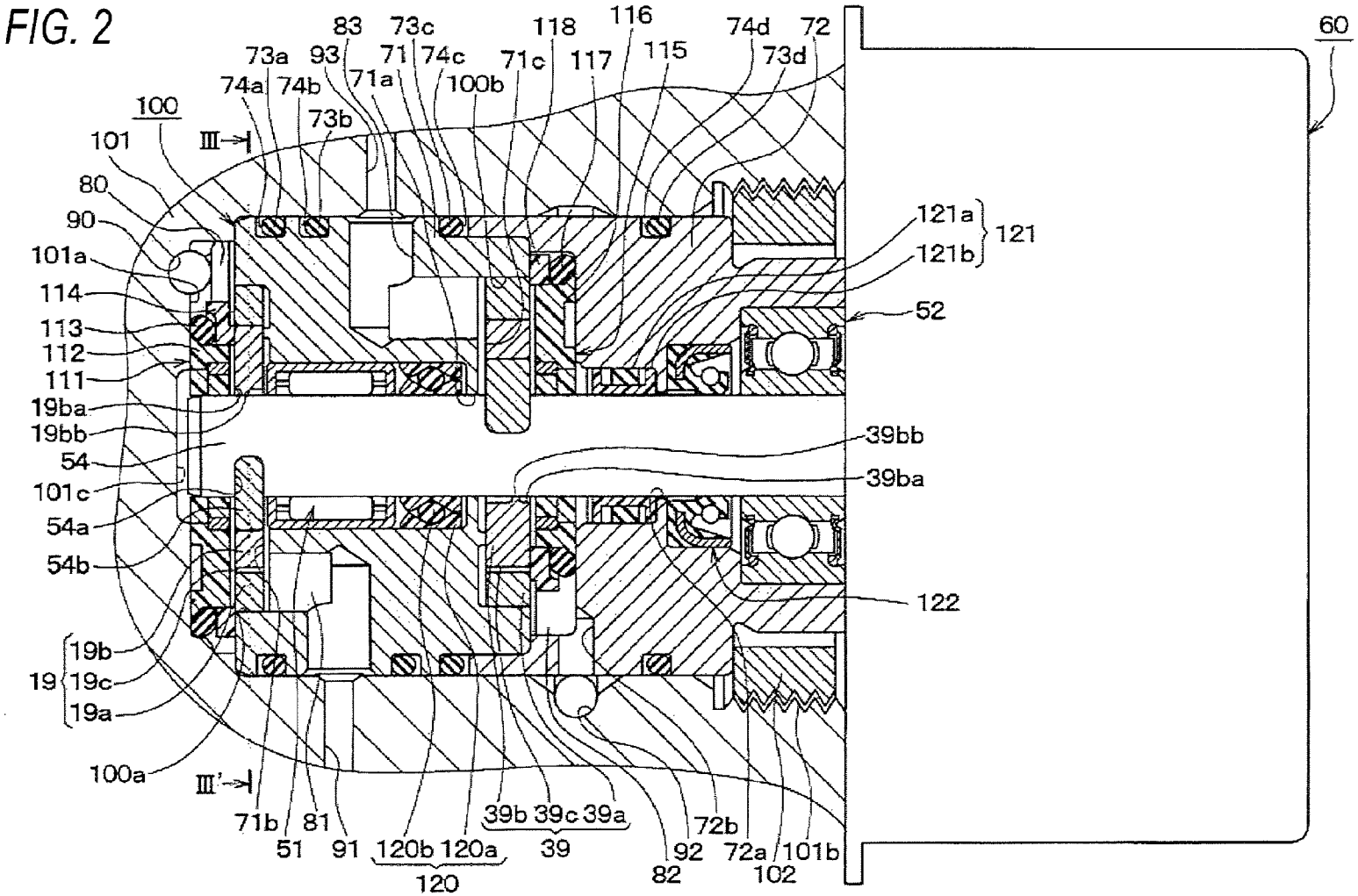
FIG. 2 is a cross-sectional view of a gear pump device including a motor 60 and a pump main body 100 which has gear pumps 19 and 39.
Figure 3:
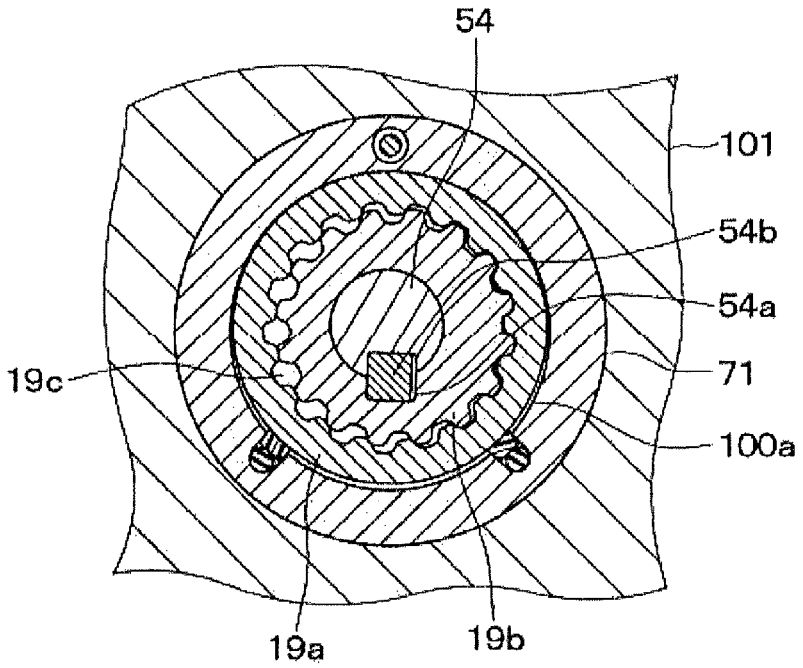
FIG. 3 is a cross-sectional view taken along a line III-III' of FIG. 2.

Next, a detailed structure of the gear pump device in the vehicle braking device 1 will be described with reference to FIGS. 2 and 3. FIG. 2 is a cross-sectional view of the gear pump device illustrating a state where a pump main body 100 is assembled into a housing 101 of the brake fluid pressure controlling actuator 50. FIG. 3 is a cross-sectional view taken along a line III-III' of FIG. 2. For example, the pump main body 100 is assembled such that the upper-lower direction in FIGS. 2 and 3 is coincident with an upper-lower direction of a vehicle.

As described above, the vehicle braking device 1 has two systems of the first piping system 50*a* and the second piping system 50*b*. Therefore, the pump main body 100 includes two gear pumps of a gear pump 19 for the first piping system 50*a* and a gear pump 39 for the second piping system 50*b*.

The gear pumps 19 and 39 incorporated in the pump main body 100 are driven by the motor 60 configured to rotate the rotary shaft 54 supported by a first bearing 51 and a second bearing 52. A casing configuring an outer shape of the pump main body 100 has a cylinder 71 and a plug 72 which are made of aluminum. The first bearing 51 is provided in the cylinder 71 and the second bearing 52 is provided in the plug 72.

In a state where the cylinder 71 and the plug 72 are coaxially arranged, one end side of the cylinder 71 is press-fitted to and integrated with the plug 72, thereby configuring the case of the pump main body 100. Then, the cylinder 71, the plug 72, the gear pumps 19 and 39, and various sealing members are provided together, thereby configuring the pump main body 100.

Accordingly, the pump main body 100 is configured as an integrated structure. The pump main body 100 having the integrated structure is inserted into a substantially cylindrical-shaped recess 101*a* formed in the housing 101 made of aluminum from the right direction in FIG. 2. A ring-shaped male screw member (screw) 102 is screwed into a female screw groove 101*b* formed by drilling an entrance of the recess 101*a*, and thus, the pump main body 100 is fixed to the housing 101. The screwing of the male screw member 102 can achieve a structure where the pump main body 100 cannot slip out from the housing 101.

In the description of the present illustrative embodiment, a direction where the pump main body 100 is inserted into the recess 101*a* of the housing 101 is referred to as an inserting direction. In addition, an axial direction or a circumferential direction of the pump main body 100 (axial direction or circumferential direction of the rotary shaft 54) is simply referred to as an axial direction or a circumferential direction.

In a front tip position of the recess 101*a* in the inserting direction, that is, in a position of a bottom portion of the recess 101*a* corresponding to a tip of the rotary shaft 54 (left side end portion in FIG. 2), a circular-shaped second recess 101*c* is formed. The second recess 101*c* has a diameter larger than a diameter of the rotary shaft 54. The tip of the rotary shaft 54 is positioned inside the second recess 101*c* so that the rotary shaft 54 does not come into contact with the housing 101.

The cylinder 71 and the plug 72 are formed with center holes 71*a* and 72*a*, respectively. The rotary shaft 54 is inserted into these center holes 71*a* and 72*a*. The cylinder 71 and the plug 72 are supported by the first bearing 51 fixed to the inner periphery of the center hole 71*a* of the cylinder 71 and the second bearing 52 fixed to the inner periphery of the center hole 72*a* of the plug 72.

The gear pumps 19 and 39 are respectively provided to both sides of the first bearing 51, that is, a front region in the inserting direction from the first bearing 51 and a region interposed between the first and second bearings 51 and 52.

As illustrated in FIG. 3, the gear pump 19 is provided inside a rotor chamber (accommodation portion) 100*a* configured by a circular-shaped recess which is formed on one end surface of the cylinder 71. The gear pump 19 is configured by an internal-type gear pump (trochoid pump) driven by the rotary shaft 54 inserted into the rotor chamber 100*a*.

Specifically, the gear pump 19 includes a rotation unit having an outer rotor 19*a* formed with an internal gear on an inner periphery thereof and an inner rotor 19*b* formed with an external gear on an outer periphery thereof. The rotary shaft 54 is inserted into a center hole 19*ba* of the inner rotor 19*b*. Further, a key 54*b* is fitted into a hole 54*a* formed in the rotary shaft 54, and the key 54*b* allows a torque to be transferred to the inner rotor 19*b*.

In the outer rotor 19*a* and the inner rotor 19*b*, a plurality of gap portions 19*c* are formed by the internal gear and external gear meshing with each other. The rotation of the rotary shaft 54 changes the gap portions 19*c* to be large or small, thereby enabling the brake fluid to be suctioned or discharged.

On the other hand, as illustrated in FIG. 2, the gear pump 39 is provided inside a rotor chamber (accommodation portion) 100*b* configured by a circular-shaped recess which is formed on the other end surface of the cylinder 71, and is driven by the rotary shaft 54 inserted into the rotor chamber 100*b*. Similarly to the gear pump 19, the gear pump 39 includes an outer rotor 39*a* and an inner rotor 39*b*, and the rotary shaft 54 is inserted into a center hole 39*ba* of the inner rotor 39*b*. The gear pump 39 is configured by an internal-type gear pump which suctions and discharges the brake fluid using a plurality of gap portions 39*c* formed by both gears of the respective rotors 39*a* and 39*b* meshing with each other. The gear pump 39 is provided such that the gear pump 19 is rotated about the center of the rotary shaft 54 by approximately 180 degrees. This arrangement allows the gap portions 19*c* and 39*c* at a suctioning side of the gear pumps 19 and 39 to be positioned symmetrical to the gap portions 19*c* and 39*c* at a discharging side about the center of the rotary shaft 54. According to this configuration, it is possible to offset force which is applied to the first bearing 51 by the high brake fluid pressure at the discharging side.

The gear pumps 19 and 39 basically have the same structure, but the axial thickness is different from each other. As compared to the gear pump 19 for the rear system, the gear pump 39 for the front system has a longer axial length. Specifically, the respective rotors 39*a* and 39*b* of the gear pump 39 have the axial length longer than that of the respective rotors 19*a* and 19*b* of the gear pump 19. Therefore, the gear pump 39 has suction and discharge amounts of the brake fluid which are larger than those of the gear pump 19, thereby enabling more brake fluid to be supplied to the front system than to the rear system.

In the present illustrative embodiment, a structure of the inner peripheral surface of the respective inner rotors 19*b* and 39*b* in the gear pumps 19 and 39 is changed from the related-art structure. Accordingly, it is possible to ensure sealing performance between each of the inner rotors 19*b* and 39*b* and the cylinder 71. The structure of the inner peripheral surface of the inner rotors 19*b* and 39*b* will be described later in detail.

One end surface side of the cylinder 71 is provided with a sealing mechanism 111 which presses the gear pump 19 toward the cylinder 71 at a side opposite to the cylinder 71 across the gear pump 19, that is, between the housing 101, and the cylinder 71 and the gear pump 19. Further, the other end surface side of the cylinder 71 is provided with a sealing mechanism 115 which presses the gear pump 39 toward the cylinder 71 at a side opposite to the cylinder 71 across the gear pump 39, that is, between the plug 72, and the cylinder 71 and the gear pump 39.

The sealing mechanism 111 includes a ring-shaped member having a hollow portion to which the rotary shaft 54 is inserted. The sealing mechanism 111 presses the outer rotor 19*a* and the inner rotor 19*b* toward the cylinder 71, thereby sealing a relative low pressure portion and a relatively high pressure portion of one end surface side of the gear pump 19. Specifically, the sealing mechanism 111 achieves a sealing function by coming into contact with a bottom surface of the recess 101*a* which is an outer shell of the housing 101, and the outer rotor 19*a* and the inner rotor 19*b* at appropriate positions.

In the present illustrative embodiment, the sealing mechanism 111 includes an inner member 112 having a hollow rectangular shape, an annular rubber member 113, and an outer member 114 having a hollow rectangular shape. The inner member 112 is fitted into the outer member 114 in a state where the annular rubber member 113 is provided between the outer peripheral wall of the inner member 112 and the inner peripheral wall of the outer member 114.

The sealing mechanism 111 has an outer diameter which is smaller than an inner diameter of the recess 101*a* of the housing 101 at least at an upper side in FIG. 2. According to this configuration, the brake fluid can flow through a gap between the sealing mechanism 111 and the recess 101*a* of the housing 101 at the upper side in FIG. 2. The gap configures a discharge chamber 80 and is connected to a discharging pipeline 90 which is formed in the bottom portion of the recess 101*a* of the housing 101. This structure enables the gear pump 19 to discharge the brake fluid using the discharge chamber 80 and the discharging pipeline 90 as a discharge path. When the gear pump 19 is operated, the outer member 114 is pressed toward the gear pump 19 by the brake fluid pressure of the high pressure discharging side, thereby further ensuring the sealing performance on one end surface of the gear pump 19 by using the sealing mechanism 111.

The cylinder 71 has a suction port 81 which communicates with the gap portion 19*c* at the suctioning side of the gear pump 19. The suction port 81 is extended from the end surface of the gear pump 19 to the outer peripheral surface of the cylinder 71, and is connected to a suctioning pipeline 91 provided on a lateral surface of the recess 101*a* of the housing 101. This structure enables the gear pump 19 to introduce the brake fluid using the suctioning pipeline 91 and the suction port 81 as a suction path.

On the other hand, the sealing mechanism 115 also has a ring-shaped member having a hollow portion to which the rotary shaft 54 is inserted. The sealing mechanism 115 presses the outer rotor 39*a* and the inner rotor 39*b* toward the cylinder 71, thereby sealing a relative low pressure portion and a relatively high pressure portion of one end surface side of the gear pump 39. Specifically, the sealing mechanism 115 achieves a sealing function by coming into contact with an end surface of the plug 72 at a portion for accommodating the sealing mechanism 115, and the outer rotor 39*a* or the inner rotor 39*b* at appropriate positions.

The sealing mechanism 115 has an inner member 116 having a hollow rectangular shape, an annular rubber member 117, and an outer member 118 having a hollow rectangular shape. Then, the inner member 116 is fitted into the outer member 118 in a state where the annular rubber member 117 is provided between the outer peripheral wall of the inner member 116 and the inner peripheral wall of the outer member 118.

The sealing mechanism 115 has a basic structure which is the same as that of the sealing mechanism 111. However, since a surface configuring the sealing is opposite to that of the above-described sealing mechanism 111, the structure is changed accordingly. Specifically, the sealing mechanism 115 has a shape which is symmetrical to the shape of the sealing mechanism 111, and is arranged to be shifted in phase by 180 degrees about the center of the rotary shaft 54 with respect to the sealing mechanism 111. Except for this, the sealing mechanism 115 has a structure similar to the sealing mechanism 111.

The sealing mechanism 115 has an outer diameter which is smaller than an inner diameter of the plug 72 at least at a lower side in FIG. 2. Therefore, in this configuration, the brake fluid can flow through a gap between the sealing mechanism 115 and the plug 72 at the lower side in FIG. 2. The gap configures a discharge chamber 82 and is connected to a communication path 72*b* formed in the plug 72 and a discharging pipeline 92 which is formed on the lateral surface of the recess 101*a* of the housing 101. This structure enables the gear pump 39 to discharge the brake fluid using the discharge chamber 82, the communication path 72*b* and the discharging pipeline 92 as a discharge path. When the gear pump 39 is operated, the outer member 118 is pressed toward the gear pump 39 by the brake fluid pressure of the high pressure discharging side, thereby further ensuring the scaling performance on one end surface of the gear pump 39 by using the sealing mechanism 115.

On the other hand, the surfaces of the cylinder 71 at sides of the gear pumps 19 and 39 also serve as sealing surfaces 71*b* and 71*c*, and the gear pumps 19 and 39 come into close contact with the respective sealing surfaces 71*b* and 71*c*. Thus, the sealing (mechanical sealing) function is achieved. Accordingly, the relatively low pressure portion and the relatively high pressure portion of the gear pumps 19 and 39 at the other end surface side are sealed.

The cylinder 71 has a suction port 83 which communicates with the gap portion 39*c* of the suctioning side of the gear pump 39. The suction port 83 is extended from the end surface of the gear pump 39 to the outer peripheral surface of the cylinder 71, and is connected to a suctioning pipeline 93 provided on a lateral surface of the recess 101*a* of the housing 101. This structure enables the gear pump 39 to introduce the brake fluid using the suctioning pipeline 93 and the suction port 83 as a suction path.

Incidentally, the suctioning pipeline 91 and the discharging pipeline 90 in FIG. 2 correspond to the pipeline C in FIG. 1, and the suctioning pipeline 93 and the discharging pipeline 92 correspond to the pipeline G in FIG. 1.

In addition, the center hole 71*a* of the cylinder 71 accommodates, at a further rear portion from the first bearing in the inserting direction, a sealing member 120 including an annular resin member 120*a* having a U-shaped radial cross section and an annular rubber member 120*b* fitted into the annular resin member 120*a*. This sealing member 120 seals between two systems in the center hole 71*a* of the cylinder 71.

The center hole 72*a* of the plug 72 has a stepped shape such that the inner diameter is decreased in three stages from the front portion to the rear portion. A stepped portion of the first stage which is located at the most rear side in the inserting direction accommodates a sealing member 121. The sealing member 121 is configured such that an elastic ring 121*a* formed by an elastic member such as rubber is fitted to a ring-shaped resin member 121*b* having a groove portion in which the radial direction is a depth direction. The sealing member 121 is configured to come into contact with the rotary shaft 54 such that the resin member 121*b* is pressed by the elastic force of the elastic ring 121*a*.

The above-described sealing mechanism 115 is accommodated in a stepped portion of the second stage adjacent to the stage where the sealing member 121 is provided within the center hole 72*a*. The above-described communication route 72*b* is formed from this stepped portion to the outer peripheral surface of the plug 72. An end portion located in the rear side in the inserting direction of the cylinder 71 is press-fitted to a stepped portion of the third stage which is located at the most front side in the inserting direction within the center hole 72*a*. A portion of the cylinder 71 to be fitted into the center hole 72*a* of the plug 72 is configured such that the outer diameter is more decreased than other portions of the cylinder 71. An axial dimension of the portion having the decreased diameter within the cylinder 71 is larger than an axial dimension of the stepped portion of the third stage of the center hole 72*a*. Therefore, when the cylinder 71 is press-fitted into the center hole 72*a* of the plug 72, a groove portion 74*c* is formed at a tip position of the plug 72 by the cylinder 71 and the plug 72.

Furthermore, the center hole 72*a* of the plug 72 has a diameter partially enlarged in the rear portion in the inserting direction, and the portion is provided with oil seal (sealing member) 122. Accordingly, since the oil seal 122 is provided at side of the motor 60 with respect to the sealing member 121, the sealing member 121 basically prevents the brake fluid from leaking out through the center hole 72*a*, and the oil seal 122 further ensure to prevent the leakage.

The outer periphery of the pump main body 100 is provided with O-rings 73*a* to 73*d* as an annular member so as to seal each portion. These O-rings 73*a* to 73*d* seal the brake fluid between two respective systems formed in the housing 101 or the discharge path and the suction path of each system. The O-ring 73*a* is provided between the discharge chamber 80 and the discharging pipeline 90, and the suction port 81 and the suctioning pipeline 91. The O-ring 73*b* is provided between the suction port 81 and the suctioning pipeline 91, and the suction port 83 and the suctioning pipeline 93. The O-ring 73*c* is provided between the suction port 83 and the suctioning pipeline 93, and the discharge chamber 82 and the discharging pipeline 92. The O-ring 73*d* is provided between the discharge chamber 82 and the discharging pipeline 92, and the outside of the housing 101. The O-rings 73*a*, 73*c* and 73*d* are provided simply in a circular shape so as to circumferentially surround the rotary shaft 54 about the center of the rotary shaft 54. The O-ring 73*b* circumferentially surround the rotary shaft 54 about the center of the rotary shaft 54, and is arranged to be axially shifted. Accordingly, it is possible to reduce the dimension of the rotary shaft 54 in the axial direction.

In order for the O-rings 73*a* to 73*d* to be provided, the outer periphery of the pump main body 100 is formed with groove portions 74*a* to 74*d*. The groove portions 74*a* and 74*b* are formed so that the outer periphery of the cylinder 71 is partially recessed. The groove portion 74*c* is formed by a portion where the outer periphery of the cylinder 71 is recessed, and a tip portion of the plug 72. The groove portion 74*d* is formed so that the outer periphery of the plug 72 is partially recessed. In a state where the O-rings 73*a* to 73*d* are fitted into the respective groove portions 74*a* to 74*d* as described above, the pump main body 100 is inserted into the recess 101*a* of the housing 1001. Accordingly, the respective O-rings 73*a* to 73*d* are crushed on the inner wall surface of the recess 101*a*, thereby functioning as the seal.

Furthermore, the outer peripheral surface of the plug 72 is decreased in diameter in the rear portion in the inserting direction to configure a stepped portion. The above-described ring-shaped male screw member 102 is fitted to and mounted on the decreased portion, thereby fixing the pump main body 100.

Figure 4B:
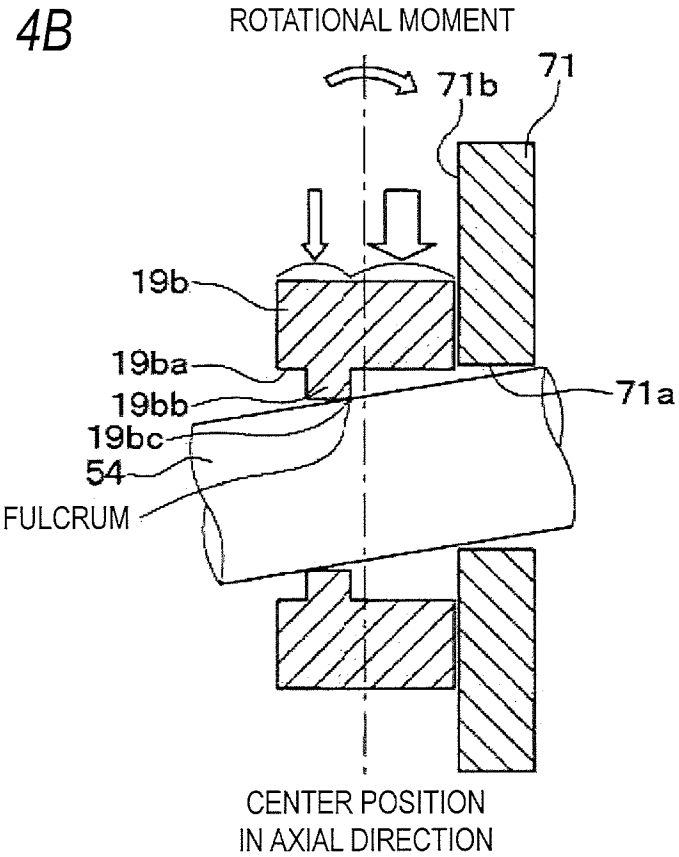
FIGS. 4A and 4B are partial enlarged cross-sectional views schematically illustrating the vicinity of an inner rotor 19*b* of the gear pump 19 and a sealing surface 71*b* of a cylinder 71.
Figure 4A:
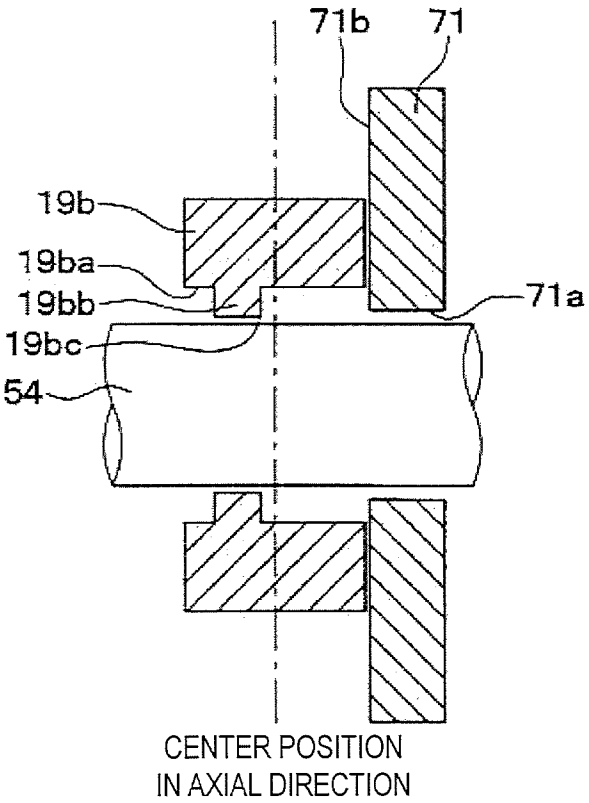
Figure 5:
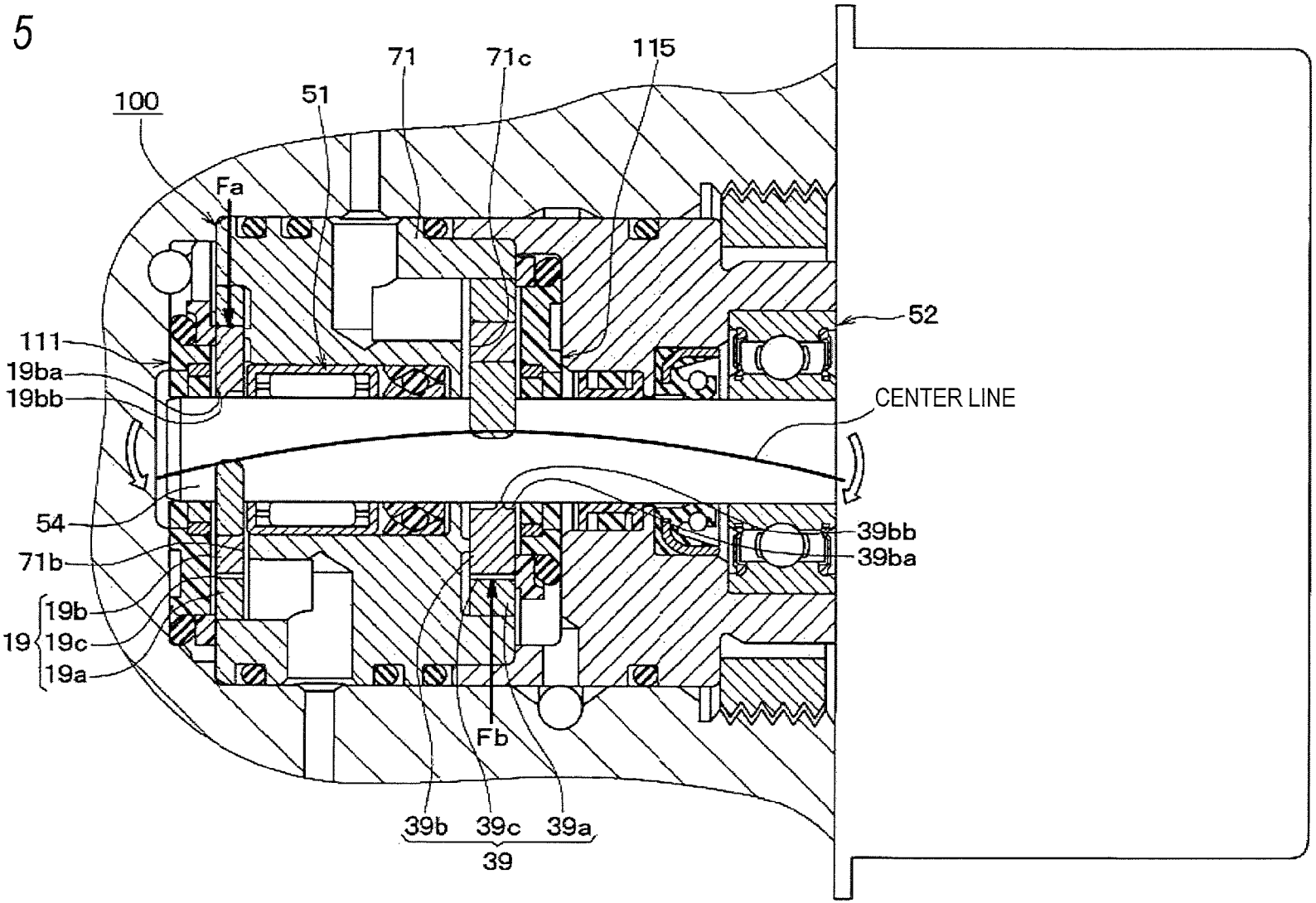
FIG. 5 is a cross-sectional view schematically illustrating a trajectory of a center line of a rotary shaft 54 when the rotary shaft 54 is deformed during a pump operation.

The above-described structure configures the gear pump device. Next, a detailed structure of the inner peripheral surface of the inner rotors 19*b* and 39*b* in the gear pumps 19 and 39 will be described with reference to FIGS. 4A, 4B and 5. Referring to FIGS. 4A, 4B and 5, the inner rotor 19*b* will be described as an example, but the inner rotor 39*b* also has the similar configuration.

FIGS. 4A and 4B are partial enlarged view of the vicinity of the inner rotor 19*b* of the gear pump 19 and the sealing surface 71*b* of the cylinder 71. FIG. 5 is a cross-sectional view schematically illustrating a trajectory of the center line of the rotary shaft 54 when the rotary shaft 54 is deformed during the pump operation.

Figure 9:
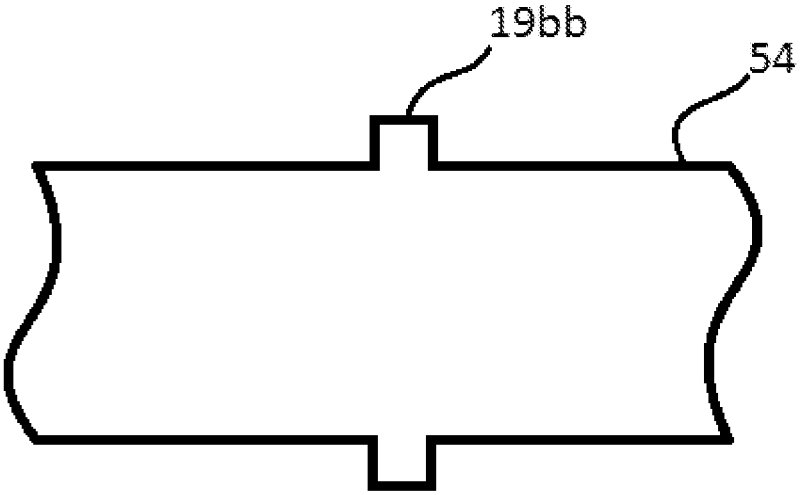
FIG. 9 is a schematic partial cross-sectional view of a rotary shaft with a support portion provided on the rotary shaft.

As illustrated in FIGS. 2, 4A and 4B, the inner peripheral surface of center holes 19*ba* and 39*ba* of the inner rotors 19*b* and 39*b* have support portions 19*bb* and 39*bb*, respectively, which protrude inward in the radial direction over an entire circumference. The support portions 19*bb* and 39*bb* support the inner rotors 19*b* and 39*b* to be tiltable to the rotary shaft 54, respectively. In the present illustrative embodiment, as illustrated in FIG. 4A, the support portion 19*bb* has a rectangular shape in cross section. The support portion 19*bb* is deviated to a side away from the sealing surface 71*b* in the axial direction of the rotary shaft 54. Furthermore, in the present illustrative embodiment, a deviated amount is set such that a corner portion 19*bc* of the support portion 19*bb* at a side of the sealing surface 71*b* is positioned at a side away from the sealing surface 71*b* further than the center of the inner rotor 19*b* in the axial direction. Therefore, the brake fluid having the high pressure is applied to the outer peripheral surface of the inner rotor 19*b*, that is, a surface of the external gear side, so that the force is applied inward in the radial direction of the inner rotor 19*b*, it is possible to generate the rotational moment which presses the inner rotor 19*b* toward the sealing surface 71*b*. Alternatively, the support portion 19*bb* may be provided on the rotary shaft 54, as shown for example in FIG. 9.

For example, in the gear pump device of the present illustrative embodiment, the gear pump 19 has a cantilever structure in which only one side thereof is supported by the first bearing 51. The gear pump 39 has a double-supported structure in which both sides are supported by the first and second bearings 51 and 52. In this configuration, since the respective gear pumps 19 and 39 are provided to be rotated by 180 degrees, portions which are caused to have the high pressure during the operation of the pump are also in a rotated state by 180 degrees. Specifically, referring to FIG. 5, in the outer peripheral surface of the inner rotors 19*b* and 39*b*, a discharge pressure which has the high pressure is applied to a portion at an upper side in FIG. 5 for the gear pump 19 and a portion at a lower side in FIG. 5 for the gear pump 39. Therefore, as illustrated in FIG. 5, a force Fa is applied downward in the gear pump 19, and a force Fb is applied upward in the gear pump 39. The center position of the rotary shaft 54 in the axial direction is deflected upward, and both ends of the rotary shaft 54 are deflected downward (refer to an arrow in FIG. 5).

Therefore, in the gear pump 19, for example, as illustrated in FIG. 4B, tilting of the rotary shaft 54 causes the corner portion 19*bc* of the support portion 19*bb* at a side of the sealing surface 71*b* to come into contact with the rotary shaft 54, in the high pressure side in the inner rotor 19*b*, that is, in the upper side of FIG. 4B. Therefore, across the plane which passes through the corner portion 19*bc* and is parallel to the radial direction of the rotary shaft 54, based on an area difference in the outer peripheral surface of the inner rotor 19*b* between a side of the sealing surface 71*b* and a side away from the sealing surface 71 with respect to the corner portion 19*bc*, the rotational moment is generated according to the area difference. Accordingly, the rotational moment is generated clockwise in FIG. 4B, and the force is applied to the side in which the end surface of the inner rotor 19*b* at the vicinity of the high pressure side pressure chamber is pressed toward the sealing surface 71*b*.

In this manner, it is possible to prevent generation of the rotational moment in the direction in which the end surface of the inner rotor 19*b* at the vicinity of the high pressure side pressure chamber is separated from the sealing surface 71*b*. Therefore, it is possible to further ensure the sealing performance. In particular, in the present illustrative embodiment, it is possible to generate the rotational moment to the direction in which the end surface of the inner rotor 19*b* is pressed against the sealing surface 71*b*. Therefore, it is possible to further ensure the sealing performance between the end surface of the inner rotor 19*b* and the sealing surface 71*b*.

In addition, since the rotational moment is generated in the direction in which the end surface of the inner rotor 19*b* is pressed against the sealing surface 71*b*, the inner rotor 19*b* does not follow the deflection of the rotary shaft 54, so that the inner rotor 19*b* is rotated while maintaining a favorable sliding state with respect to the sealing surface 71*b*. Therefore, a favorable pump operation can be achieved.

As described above, in the gear pump device according to the present illustrative embodiment, the support portion 19*bb* is deviated to the side away from the sealing surface 71*b* in the axial direction of the rotary shaft 54. Therefore, when the high pressure is applied to the outer peripheral surface of the inner rotor 19*b*, that is, the surface of the external gear side, and the force is applied inward in the radial direction of the inner rotor 19*b*, it is possible to prevent the generation of the rotational moment in the direction in which the end surface of the inner rotor 19*b* at the vicinity of the high pressure side pressure chamber is separated from the sealing surface 71*b*. Accordingly, it is possible to further ensure the sealing performance. In particular, in the present illustrative embodiment, the corner portion 19*bc* of the support portion 19*bb* at a side of the sealing surface 71*b* is positioned at the side away from the sealing surface 71*h* further than the center position of the inner rotor 19*b* in the axial direction. Therefore, it is possible to further ensure the sealing performance by generating the rotational moment which presses the inner rotor 19*b* toward the sealing surface 71*b*.

In addition, in the gear pump device of the present illustrative embodiment, one end surface of the end surfaces of the inner rotors 19*b* and 39*b* in the axial direction is sealed by coming into contact with the sealing mechanisms 111 and 115 which are pressed toward the inner rotors 19*b* and 39*b* by the high pressure. Then, the other end surface of the end surfaces of the inner rotors 19*b* and 39*b* in the axial direction is sealed by bringing the inner rotors 19*b* and 39*b* into contact with the sealing surfaces 71*b* and 71*c* by the force which is applied toward the inner rotors 19*b* and 39*b* by the sealing mechanisms 111 and 115. In this configuration, if the rotational moment is increased in the direction in which the other end surface is separated from the sealing surfaces 71*b* and 71*c*, it is not possible to ensure the sealing performance. Accordingly, in this configuration, it is particularly effective to prevent the generation of the rotational moment in the direction in which the end surfaces of the inner rotors 19*b* and 39*b* at the vicinity of the high pressure side pressure chamber is separated from the sealing surfaces 71*b* and 71*c*.

Second Illustrative Embodiment

A second illustrative embodiment of the present invention will be described. The present illustrative embodiment is configured such that a shape of the support portion 19*bb* is changed from the first illustrative embodiment. The other elements are the same as those of the first illustrative embodiment. Therefore, only the portions different from those of the first illustrative embodiment will be described.

Figure 6:
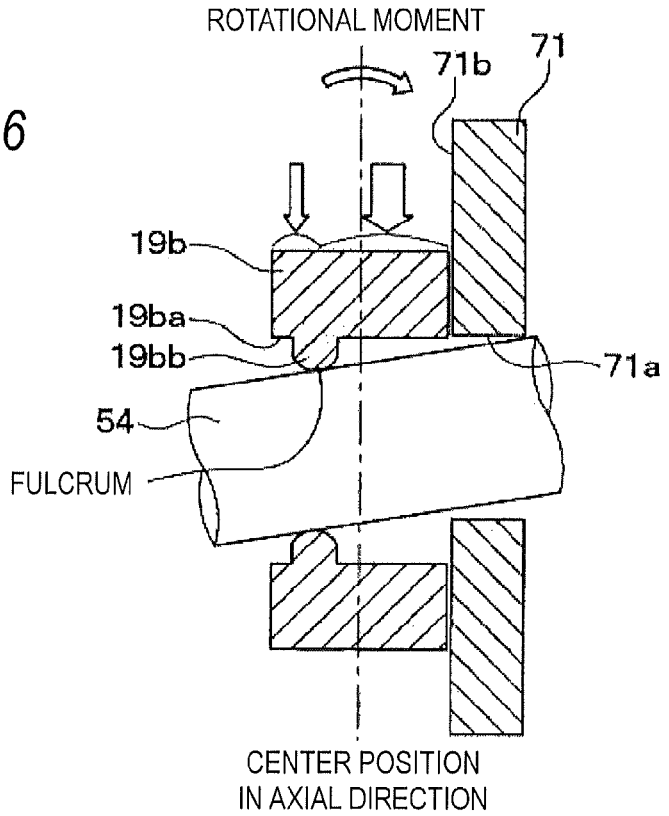
FIG. 6 is a partial enlarged cross-sectional view schematically illustrating the vicinity of an inner rotor 19*b* of a gear pump 19 and a sealing surface 71*b* of a cylinder 71 included in a gear pump device according to a second illustrative embodiment.

FIG. 6 is a partial enlarged view schematically illustrating the vicinity of the inner rotor 19*b* of the gear pump 19 and the sealing surface 71*b* of the cylinder 71 included in the gear pump device according to the present illustrative embodiment. As illustrated in FIG. 6, the tip of the support portion 19*bb* has a semicircular shape in cross section. In the present illustrative embodiment, a deviated amount of the support portion 19*bb* is set such that a portion of the support portion 19*bb* which comes into contact with the deflected rotary shaft 54 is positioned at the side away from the sealing surface 71*b* further than the center of the inner rotor 19*b* in the axial direction.

In a case where the tip of the support portion 19*bb* has the semicircular shape in this manner, since the support portion 19*bb* has no corner portion 19*bc*, when the rotary shaft 54 is deflected, a portion of the outer peripheral surface of the support portion 19*bb* is brought into contact with the rotary shaft 54. Even in this structure, since the support portion 19*bb* is deviated to the side away from the sealing surface 71*b* in the axial direction of the rotary shaft 54, it is possible to obtain an effect similar to that of the first illustrative embodiment. Furthermore, in the present illustrative embodiment, the deviated amount of the support portion 19*bb* is set such that the portion of the support portion 19*bb* which comes into contact with the deflected rotary shaft 54 is positioned at the side away from the sealing surface 71*b* further than the axial center of the inner rotor 19*b*. Therefore, it is possible to further ensure the sealing performance by generating the rotational moment which presses the inner rotor 19*b* toward the sealing surface 71*b*.

Third Illustrative Embodiment

A third illustrative embodiment of the present invention will be described. The present illustrative embodiment is configured such that a shape of the support portion 19*bb* is changed from the first illustrative embodiment. The others are the same as those of the first illustrative embodiment. Therefore, only the portions different from those of the first illustrative embodiment will be described.

Figure 7:
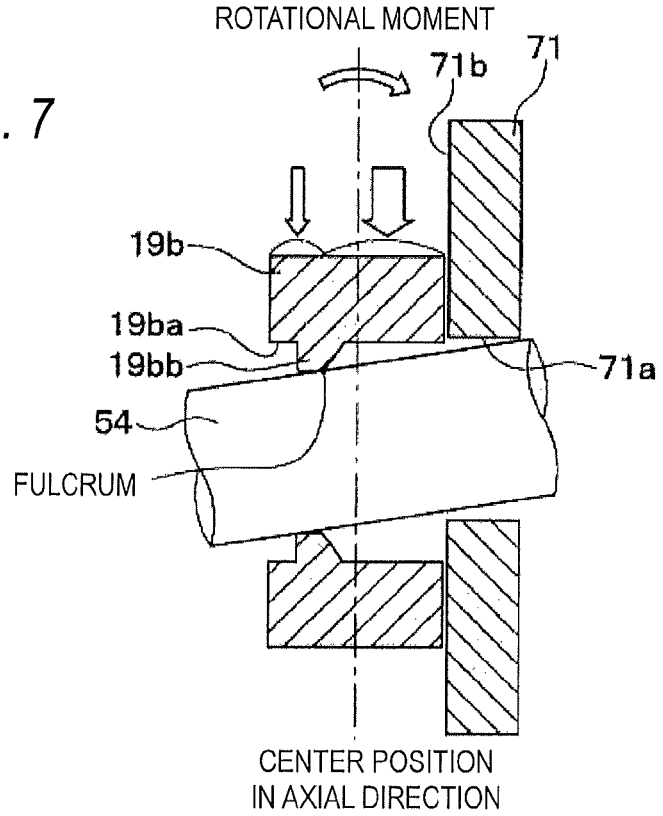
FIG. 7 is a partial enlarged cross-sectional view schematically illustrating the vicinity of an inner rotor 19*b* of a gear pump 19 and a sealing surface 71*b* of a cylinder 71 included in a gear pump device according to a third illustrative embodiment.
Figure 8B:
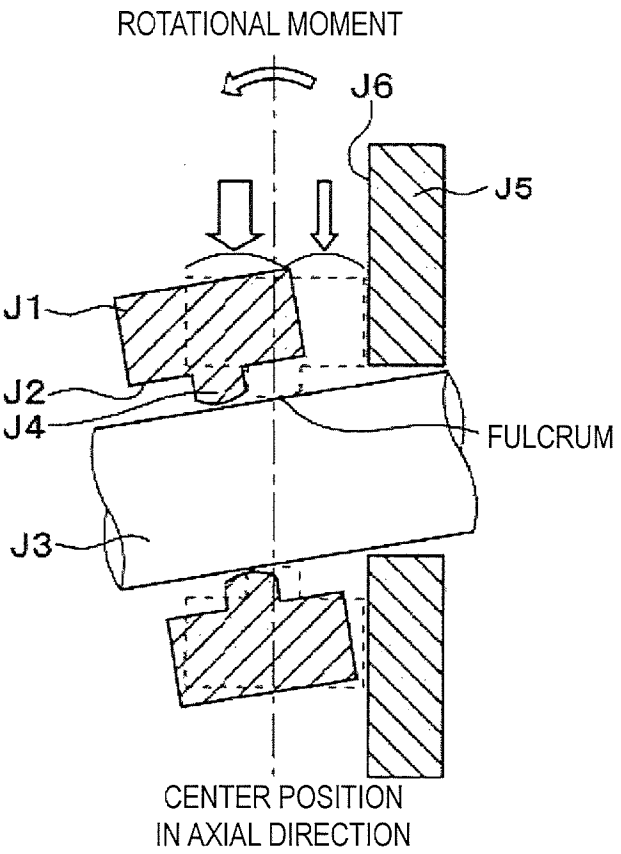
FIGS. 8A and 8B are schematic views illustrating a rotational moment applied to a structure having a support portion J4 on an inner peripheral surface of a rotor J1 at a center position in an axial direction.
Figure 8A:
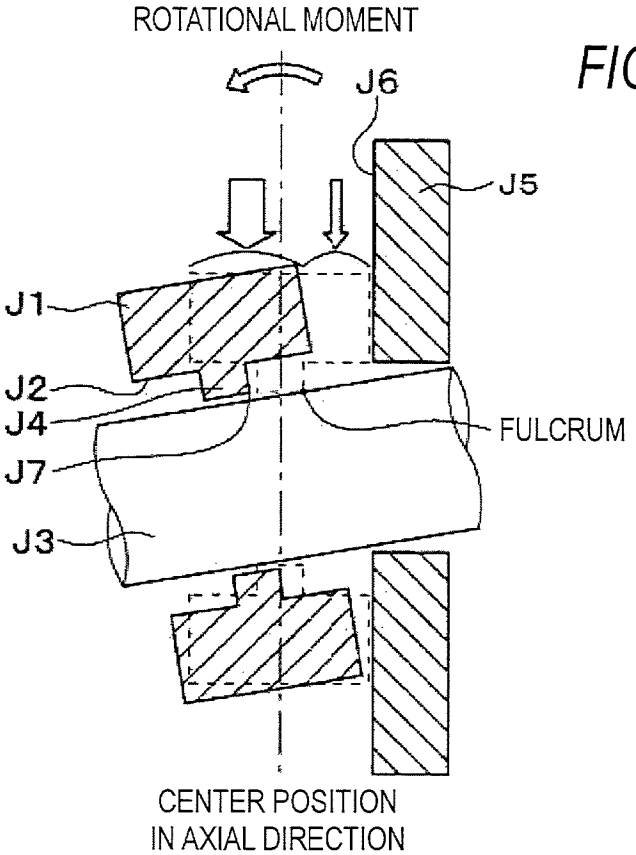

FIG. 7 is a partial enlarged view schematically illustrating the vicinity of the inner rotor 19*b* of the gear pump 19 and the sealing surface 71*b* of the cylinder 71 included in the gear pump device according to the present illustrative embodiment. As illustrated in FIG. 7, the support portion 19*bb* has a quadrangular shape in cross section which. Specifically, the support portion 19*bb* has a tilted surface at a side of the sealing surface 71*b* such that the tip of the support portion 19*bb* has a tapered shape. Furthermore, in the present illustrative embodiment, a deviated amount of the support portion 19*bb* is set such that a portion of the support portion 19*bb* which comes into contact with the deflected rotary shaft 54 is positioned at the side away from the sealing surface 71*b* further than the center of the inner rotor 19*b* in the axial direction.

Even in this structure, since the support portion 19*bb* is deviated to the side away from the sealing surface 71*b* in the axial direction of the rotary shaft 54, it is possible to obtain an effect which is the same as that of the first illustrative embodiment. Further, since the surface of the support portion 19*bb* at a side of the sealing surface 71*b* is the tilted surface, when the corner portion 19*bc* of the support portion 19*bb* is brought into contact with the outer peripheral surface of the deflected rotary shaft 54, the support portion 19*bb* is more easy to fall down toward the tilted surface by the tilting of the tilted surface. Therefore, the rotational moment which presses the inner rotor 19*b* toward the sealing surface 71*b* becomes easy to be generated, and thus, it is possible to further ensure the sealing performance.

Other Illustrative Embodiments

While the present invention has been shown and described with reference to certain illustrative embodiments thereof, it will be understood by those skilled in the art that various changes in form and details may be made therein without departing from the spirit and scope of the invention as defined by the appended claims.

(1) For example, in the respective illustrative embodiments, the gear pump device has been described as an example of the internal rotor-type fluid machine. However, other pump devices such as a vane pump may be employed, or the internal rotor-type fluid machine other than the pump device such as a hydraulic motor may be employed. That is, in the above-described respective illustrative embodiments, as an example of the rotor and the rotary shaft, the inner rotor 19*b* and the rotary shaft 54 inserted into the center hole 19*ba* have been described. As an example of the pressure chamber, the gap portions 19*c* and 39*c* have been described. In addition, the sealing surfaces 71*b* and 71*c* of the cylinder 71 have been described as an example of the pressure chamber inner wall surface which configures the pressure chamber together with the rotor and seals the pressure chamber by coming into contact with the end surface of the rotor. However, the present invention is not limited thereto.

That is, in the configuration where the rotor configuring the pressure chamber is supported to be axially tiltable to the rotary shaft, other configurations may be employed if such internal rotor-type fluid machine includes the pressure chamber inner wall surface which comes into sliding contact while rotating relative to the axial end surface of the rotor, and which configures the pressure chamber together with the rotor. Then, even in the other internal rotor-type fluid machine, if the support portion of the rotor is deviated, using the pressure difference between the high pressure side pressure chamber and the low pressure side pressure chamber, it is possible to prevent the generation of the rotational moment in the direction in which the end surface of the rotor at the vicinity of the high pressure side pressure chamber is separated from the pressure chamber inner wall surface.

In addition, a contact point of the support portion which comes into contact with the rotary shaft is deviated to the side away from the pressure chamber inner wall surface further than the center of the rotor in the axial direction. In this manner, the rotor is rotated while maintaining a favorable sliding contact state with the pressure chamber inner wall surface, thereby enabling a more favorable pump operation.

(2) In the above-described respective illustrative embodiments, a case has been described where the support portions 19*bb* and 39*bb* have the rectangular shape in cross section or the semicircular shape in cross section. However, any other shape may be used. That is, shapes other than the rectangular shape in cross section, for example, a trapezoidal shape in cross section may be used as a structure which enables the surface contact with the tip surface of the support portions 19*bb* and 39*bb* in a state where the rotary shaft 54 is not deflected. In addition, shapes other than the semicircular shape in cross section, for example, a triangular shape in cross section, may be used as a structure which enables the line contact with the tip surface of the support portions 19*bb* and 39*bb* even in a state where the rotary shaft 54 is not deflected. A way of contact between the tip of the support portions 19*bb* and 39*bb* and the rotary shaft 54 may be either the surface contact or the line contact. However, as compared to the line contact, the surface contact allows the wider area for contact, thereby enabling high durability to be maintained.

(3) In the above-described respective illustrative embodiments, a case has been described as an example where the support portion 19*bb* is deviated in the axial direction such that the contact point of the support portions 19*bb* and 39*bb* with the deflected rotary shaft 54 is positioned at the side away from the sealing surface 71*b* further than the center of the inner rotors 19*b* and 39*b* in the axial direction. However, the contact point of the support portions 19*bb* and 39*bb* with the deflected rotary shaft 54 may not be positioned at the side away from the sealing surface 71*b* further than the axial center of the inner rotors 19*b* and 39*b*. That is, the center of the support portions 19*bb* and 39*bb* may be deviated away from the sealing surface 71*b* in the axial direction. Even in this case, as compared to the related-art configuration, it is possible to prevent the generation of the rotational moment in the direction in which the end surface of the inner rotors 19*b* and 39*b* at the vicinity of the high pressure side pressure chamber is separated from the sealing surfaces 71*b* and 71*c*. Therefore, it is possible to further ensure the sealing performance.

(4) In the above-described respective illustrative embodiments, a case has been described where the support portions 19*bb* and 39*bb* are provided to the inner rotors 19*b* and 39*b*. However, the support portions 19*bb* and 39*bb* may be provided to the rotary shaft 54.

(5) At least a portion of the outer peripheral surface of the inner rotors 19*b* and 39*b*, for example, a tooth bottom portion of a tooth surface configuring the external gear may have a tilted surface such that as proceeding to the sealing surfaces 71*b* and 71*c*, the outer diameter of the inner rotors 19*b* and 39*b* become larger. That is, the outer peripheral surface of the rotor is tilted such that the outer diameter of the rotor configuring the pressure chamber is increased as it is closer to the pressure chamber inner wall surface. According to this configuration, the high pressure in the pressure chamber is perpendicularly applied to the tilted surface. Accordingly, it is possible to provide the force which presses the rotor toward the pressure chamber inner wall surface. Therefore, it is possible to generate the rotational moment which presses the inner rotors 19*b* and 39*b* toward the sealing surfaces 71*b* and 71*c*.

(6) In the above-described respective illustrative embodiments, a structure has been described as an example where one end surface of both end surfaces of the respective gear pumps 19 and 39 is brought into contact with the sealing surfaces 71*b* and 71*c* of the cylinder 71. However, a structure may also be employed where both end surfaces of the gear pumps 19 and 39 are brought into contact with the sealing member such as the sealing mechanisms 111 and 115. In addition, without being limited to a case where the gear pump 19 has the cantilever structure, the present invention can be applied to a case of the double-supported structure. However, in a case of the cantilever structure, since the rotary shaft 54 is more largely deflected, it is effective if the present invention is applied to the cantilever structure.

(7) The number of rotors driven by the same rotary shaft is not limited to two, and may be one, or may be three or more.

What is claimed is:

1. An internal rotor-type fluid machine comprising:

a rotary shaft extending in an axial direction;

a rotor which rotates together with the rotary shaft, the rotor possessing one end surface at one axial end of the rotor and an other end surface at an opposite axial end of the rotor, a support portion which is provided on the rotary shaft or the rotor, and which supports the rotary shaft to be tiltable with respect to the rotor; and a pressure chamber inner wall surface which configures a pressure chamber by contacting the one end surface of the rotor in the axial direction, wherein the rotor is pressed toward the rotary shaft by a high fluid pressure, based on a pressure difference in the pressure chamber between a high pressure side and a low pressure side having a lower pressure than the high pressure side, wherein the support portion is deviated in a direction away from the pressure chamber inner wall surface further than a center position of the rotor in the axial direction, the other end surface of the rotor being sealed by coming into contact with a sealing mechanism which is pressed toward the rotor by the high fluid pressure, and the one end surface of the rotor being sealed by coming into contact with the pressure chamber inner wall surface by virtue of a force which presses the sealing mechanism toward the rotor, the sealing mechanism including:

an inner member possessing a hollow rectangular shape, an annular rubber member, and an outer member possessing a hollow rectangular shape.

2. The internal rotor-type fluid machine according to claim 1, wherein in a state where the rotor is pressed toward the rotary shaft, a rotational moment is generated by the high fluid pressure in a direction in which the end surface of the rotor in the axial direction is pressed toward the pressure chamber inner wall surface with a portion where the support portion comes into contact with the rotary shaft serving as a fulcrum.

3. The internal rotor-type fluid machine according to claim 2, wherein the fulcrum is positioned away from the pressure chamber inner wall surface in the axial direction further than the center position of the rotor in the axial direction.

4. The internal rotor-type fluid machine according to claim 1, wherein the support portion is provided on the rotor and has a tip surface which is brought into surface contact with the rotary shaft, and wherein if the rotary shaft is tilted, the support portion is brought into line contact with the rotary shaft.

5. The internal rotor-type fluid machine according to claim 1, wherein the outer member is distinct from the inner member.

6. The internal rotor-type fluid machine according to claim 1, wherein the annular rubber member is located between an outer peripheral wall of the inner member and an inner peripheral wall of the outer member.

7. A gear pump device comprising:

a rotary shaft extending in an axial direction;

an inner rotor which is formed with a center hole, to which the rotary shaft is inserted, and rotates together with the rotary shaft, the inner rotor possessing one end surface at one axial end of the inner rotor and an other end surface at an opposite axial end of the inner rotor;

an outer rotor which is provided at an outer circumference of the inner rotor;

a support portion which is provided on an inner peripheral surface of the inner rotor, and which supports the rotary shaft to be tiltable with respect to the inner rotor;

a pressure chamber inner wall surface which configures a pressure chamber, which is a gap formed between the inner rotor and the outer rotor, by contacting the one end surface of the inner rotor in the axial direction, wherein the inner rotor is pressed toward the rotary shaft by a high fluid pressure, based on a pressure difference in the pressure chamber between a high pressure side and a low pressure side having a lower pressure than the high pressure side, and wherein the support portion is deviated in a direction away from the pressure chamber inner wall surface further than a center position of the rotor in the axial direction, the other end surface of the inner rotor being sealed by coming into contact with a sealing mechanism which is pressed toward the inner rotor by the high fluid pressure, and the one end surface of the inner rotor being sealed by coming into contact with the pressure chamber inner wall surface by virtue of a force which presses the sealing mechanism toward the inner rotor, the sealing mechanism including:

an inner member possessing a hollow rectangular shape, an annular rubber member, and an outer member possessing a hollow rectangular shape.

8. The gear pump device according to claim 7, wherein the outer member is distinct from the inner member.

9. The gear pump device according to claim 7, wherein the annular rubber member is located between an outer peripheral wall of the inner member and an inner peripheral wall of the outer member.

* * * * *